United States Patent [19]

Meloni

[11] Patent Number: 4,534,287

[45] Date of Patent: Aug. 13, 1985

[54] DOT MATRIX PRINT HEAD

[75] Inventor: Robert A. Meloni, Baltimore, Md.

[73] Assignee: General Instrument Corp., Clifton, N.J.

[21] Appl. No.: 690,416

[22] Filed: Jan. 10, 1985

Related U.S. Application Data

[63] Continuation of Ser. No. 485,749, Apr. 18, 1983, abandoned.

[51] Int. Cl.[3] ..... B41J 3/12

[52] U.S. Cl. ..... 101/93.05; 400/124; 400/320

[58] Field of Search ..... 400/121, 124, 320, 322, 400/328, 352; 101/93.04, 93.05

[56] References Cited

U.S. PATENT DOCUMENTS

| | | | |
|---|---|---|---|
| 3,802,544 | 4/1974 | Howard et al. | 400/124 |
| 3,967,714 | 7/1976 | Potma et al. | 400/124 |
| 3,973,661 | 8/1976 | DeBoo et al. | 400/124 |
| 4,053,040 | 10/1977 | McGourty | 400/124 |
| 4,077,336 | 3/1978 | Talvard et al. | 400/124 X |
| 4,349,283 | 9/1982 | Sapitowicz | 400/124 |

*Primary Examiner*—Paul T. Sewell

*Attorney, Agent, or Firm*—James & Franklin

[57] ABSTRACT

Hammer actuators are mounted on a support. Instead of moving the entire massive support to traverse the paper for each line, only a low inertia member, which positions the impact ends of the print wires, is moved. The internal structure of the member facilitates minor curvature of the print wires as the member moves. The member is rapidly reciprocated relative to the support, but "dwells" for a short time at each extreme to permit indexing of the paper. Ehnanced graphic capability is possible because each print wire can print a plurality of dots for each line.

1 Claim, 7 Drawing Figures

DOT MATRIX PRINT HEAD

This is a continuation of co-pending application Ser. No. 485,749 filed on Apr. 18, 1983, abandoned.

The present invention relates to dot matrix printers and, in particular, a shuttle-type dot matrix print head with increased speed and improved graphic capability.

A dot matrix printer is an apparatus which prints a plurality of closely spaced dots, at high speed, at selected locations on a paper strip to form letters, numerals, or other intelligible symbols thereon. The dots are formed by causing contact between the paper and an ink impregnated surface at desired locations by selectively electromagnetically displacing elongated print wires mounted within the print head.

Certain types of known dot matrix print heads consist of a plurality of selectively electrically energizable solenoids, each of which has a separate print wire extending therefrom. The impact ends of the print wires are retained in a fixed position with respect to each other by a stationary wire bearing which forms a part of the head. The wire bearing has a plurality of closely spaced openings, arranged in a matrix array. Each opening receives the impact end of a different print wire. Energization of a selected solenoid results in the print wire associated therewith being displaced, such that the impact end thereof extends beyond the surface of the bearing and causes contact between the paper and the ink impregnated surface. The paper is moved relative to the wire bearing in a first direction, such that printing of symbols can take place along a line and in a second direction such that different lines can be printed.

Such heads are bulky and heavy, as well as being complex in nature and, therefore, relatively expensive to manufacture and maintain. Since the solenoids have a relatively large diameter, the solenoids require a space much larger than the dimensions of the matrix array of the print wire impact ends. Thus, complicated arrangements of the solenoids are necessary in order for a sufficient number to be incorporated into the head to provide the required number of print wires.

For this reason, the solenoids are often arranged in groups or banks at different levels or in arcuate arrays. When arranged at different levels, each group of solenoids must be provided with print wires of different length, depending upon how far the group is spaced from the wire bearing. When arranged in an arcuate array, the print wires must be curved to various degrees, according to the placement of each solenoid from the center line of the array. In this instance, rigid lubricated sheaths surrounding each print wire, so as to guide the movement thereof, may be required in order to maintain the proper wire curvature and prevent the destruction of the fragile print wires.

In order to increase the speed of the printer, some printers have been devised where the paper is held stationary as the head is moved to traverse the paper to print each line of symbols. An increase in print speed is possible under such circumstances because the platen upon which the paper is situated is quite massive and, thus, can be moved only relatively slowly. The solenoid carrying support may be moved somewhat more easily than the platen. Actuation of the solenoids can take place quite rapidly.

However, rapid movement of the solenoid carrying support is also quite difficult because it too has substantial mass and therefore high inertia. Thus, other types of actuators, having substantially less mass than solenoids, have been employed in an attempt to reduce the mass of the moving support. See, for example, U.S. Pat. No. 3,973,661, issued Aug. 10, 1976 to DeBoo, which discloses a wire matrix printer employing spring reed type actuators on a movable support. However, DeBoo's support is still too massive for the rapid movement required for high speed printing.

Another attempt to solve this problem is the solenoid printer disclosed in U.S. Pat. No. 4,053,040, issued Oct. 11, 1977 to McGourty. In that printer, solenoids are mounted in an arcuate array on a support. The wire bearing is also mounted on the support. Instead of causing the entire support to traverse the paper, the support is pivotly mounted with respect to the base of the head. The pivotal movement of the support causes the wire bearing and, thus, the impact ends of the print wires, to move in an arc adjacent the plane of the paper, to print each line of symbols.

The McGourty printer was an improvement over the concept of translating the entire solenoid head, but still required for pivoting of a large mass. Thus, while it reduced the problem of inertia, it did not solve the problem entirely because the inertia of the pivoting head still reduced the speed of the printer to an unacceptable extent. In addition, moving the wire bearing in an arc meant that the impact ends of certain print wires were located further from the plane of the paper than others at the extremes of the pivotal movement.

In order to overcome the problems associated with the solenoid-type print head, including the weight, bulk, complexity, and cost of the solenoids, solenoid actuators have, in some instances, been replaced with extremely thin, coil carrying hammer-type actuators. Hammers of this type are so thin that a plurality of closely spaced, parallelly situated hammers can be mounted between a single pair of stationary magnets. Each hammer comprises a thin planar frame having a recess into which a flat coil is received. The coil carrying portion is suspended from a support, in cantilever fashion, by an elongated flexible portion, such that it is situated in a substantially uniform magnetic field created between the permanent magnets.

The leads of each coil are connected to the circuitry designed to electrically energize the coils of selected hammers. A print wire is mounted to and extends from the frame and is displaceable therewith. When the hammer is actuated by electrically energizing the coil, sufficient electromagnetic force develops to displace the hammer from its original position such that the impact end of the print wire is moved to cause a dot to be imprinted on the paper.

Print hammers of this type are described in detail in U.S. Pat. No. 4,349,283 issued Sept. 14, 1982 to Thomas P. Sapitowicz and Robert A. Meloni, and which is assigned to the assignee hereof. The reader is referred to the patent for more detailed information concerning the structure and function of hammers of the type here under discussion.

While great advantages are achieved through the use of the hammer actuators of the type disclosed in the above cited patent, over solenoid-type actuators, even further increases in speed can be obtained by combining the use of hammer-type actuators with the idea of reducing the mass, and thus the inertia, of the part which traverses the paper to scan each line. Moreover, if each print wire can be made to print a plurality of dots per line, enhanced graphic capability can be obtained such that a wider variety of different types of symbols, such as logos, can be printed.

In general, these objectives are achieved in the present invention by keeping the support upon which the hammer actuators are mounted stationary and by moving only a very low inertia wire bearing, which carries the impact ends of the print wires, to traverse the paper. Since each hammer can be actuated a number of different times during each traversing movement of the print wire impact end positioning member, each print wire can print a plurality of dots per line and the spacing between the imprinted dots can be varied.

The print wire impact end positioning member can be made of material having a very low mass and can be at least partially hollow, such that the inertia thereof is very small. Thus, this member can be moved and stopped very rapidly, such that increased print speed results.

Since the print wire impact end positioning member need be moved only a relatively small distance to scan each line, the maximum deviation of the impact end of the print wire from its normal position, and hence the curvature of the print wire from its normal straight condition, is similarly quite small.

It should be appreciated that only the low inertia impact end positioning member is moved as each line of the paper is scanned. The hammer actuators themselves are not moved in a plane parallel to the paper. Thus, the hammer bodies, and particularly the permanent magnets associated with the hammers, are not moved as scanning takes place. Therefore, movement is confined to a very low inertia part, such that it can take place very rapidly and with great accuracy.

The movement and position of the reciprocating low mass positioning member must be achieved with substantial accuracy. Further, at certain times, the movement of the positioning member must cease so as to permit indexing of the paper relative to the print head such that the next line can be scanned. In the present invention, these objectives are obtained through the use of a simple rotatable mechanism which controls the movement of the positioning member.

It is, therefore, a prime object of the present invention to provide an improved dot matrix print head capable of printing at increased speeds.

It is another object of the present invention to provide an improved dot matrix print head with enhanced graphic capability.

It is another object of the present invention to provide an improved dot matrix print head wherein each electromagnetically actuatable hammer can be used to print a dot in a plurality of different locations on the paper.

It is another object of the present invention to provide an improved dot matrix print head wherein the location of the impact end of each of the various print wires, with respect to the paper, is varied through the use of a low inertia, reciprocatable positioning member.

It is another object of the present invention to provide an improved dot matrix print head which includes simple means for accurately moving the positioning member relative to the paper.

It is another object of the present invention to provide an improved dot matrix print head which is comprised of a relatively small number of simple and inexpensive parts which operate together reliably for a long useful life with a minimum of maintenance.

In accordance with the present invention, a dot matrix print head is provided comprising a support having a surface with an opening and a hammer having a print wire extending therefrom and through the surface opening. The hammer is mounted on the support for movement relative thereto, when actuated. Means, movable relative to the support surface, are provided for positioning the impact end of the print wire. Means are provided for moving the positioning means relative to the support surface, through a given range.

Actuation of the hammer causes movement of the impact end of the print wire extending therefrom in a first given direction (towards the paper). The positioning means is movable relative to the support surface in a second given direction (parallel to the paper). Thus, the directions of movement are substantially perpendicular to each other.

An elongated "T"-shaped protrusion or key forms a part of the support surface. The positioning means includes a similarly shaped channel or keyway into which the protrusion is movably received. The protrusion is elongated along the surface in the direction of movement of the positioning member. The channel and protrusion cooperate to form a means for guiding the movement of the positioning means.

The means for moving the positioning means relative to the support surface comprises a recess associated with the positioning means, a protrusion adapted to be received within the recess, and means for moving the protrusion. The protrusion moving means preferably comprises a substantially cylindrical member having a surface and a means for rotating the cylindrical member. The protrusion preferably comprises a track annularly disposed on the member surface and adapted to be received within the recess.

The location of the track varies relative to a central position on the cylindrical member. In particular, the location of the track relative to the central position varies, within a given range, in a sinesoidal-like manner. The track is at a first extreme of its range relative to the central position along one portion of the member surface and at a second extreme of its range relative to the central position along a second portion of the member surface. The portions of the track located at the extreme locations relative to the central position each span an extended portion of the surface of the cylindrical member. When these track portions are situated within the positioning member recess, rotation of the cylindrical member will not cause movement of the positioning member.

Thus, each time the cylindrical member is rotated through 360°, the positioning member will be located at one extreme position relative to its "home" position for a short time, move continuously from the first extreme position through the "home" position to the other extreme position, and will remain at the other extreme position for a short time. The positioning member will then move back through the "home" position to the first extreme position. The positioning member will therefore "dwell" for a brief period at each extreme of its range. During these "dwell" periods, the paper is indexed with respect to the print head such that the next line can be printed.

The recess associated with the positioning means is defined between first and second spaced members mounted thereto. Preferably, the first and second spaced members are rotatably mounted on the positioning means and have a substantially cylindrical configuration.

The positioning means comprises a partially hollow body portion with a surface having a number of openings, each adapted to receive the impact end of one of the print wires therein. A passageway is aligned with each opening and is adapted to receive a print wire therein. Each passageway preferably comprises a first portion and a second portion. The first portion has a diameter which is substantially larger than the diameter of the print wire. The second portion has a diameter only slightly larger than the diameter of the print wire. The first portion of the passageway is spaced from the support surface and is large enough to permit flexing of the print wire as the positioning member is moved. The second portion of the passageway is situated between the opening and the first passageway, and is aligned with the body surface opening such that it moves the impact end of the print wire as the positioning member moves.

To these and to such other objects which may hereinafter appear, the present invention relates to an improved dot matrix print head as described in detail in the following specification and recited in the annexed claims, taken together with the accompanying drawings, wherein like numerals refer to like parts and in which:

Figure 1:
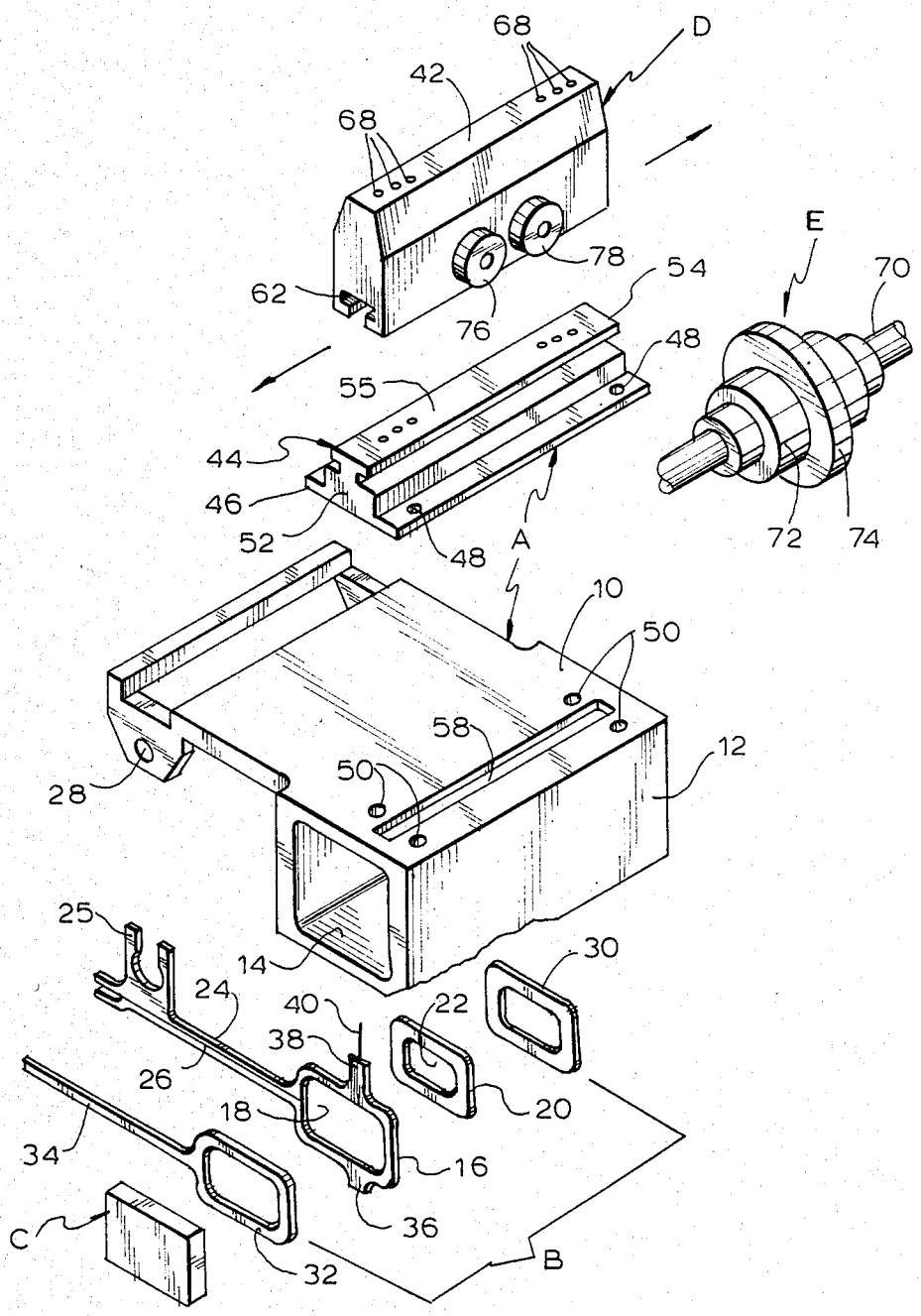
FIG. 1 is an exploded isometric view of the improved dot matrix print head of the present invention.
Figure 2:
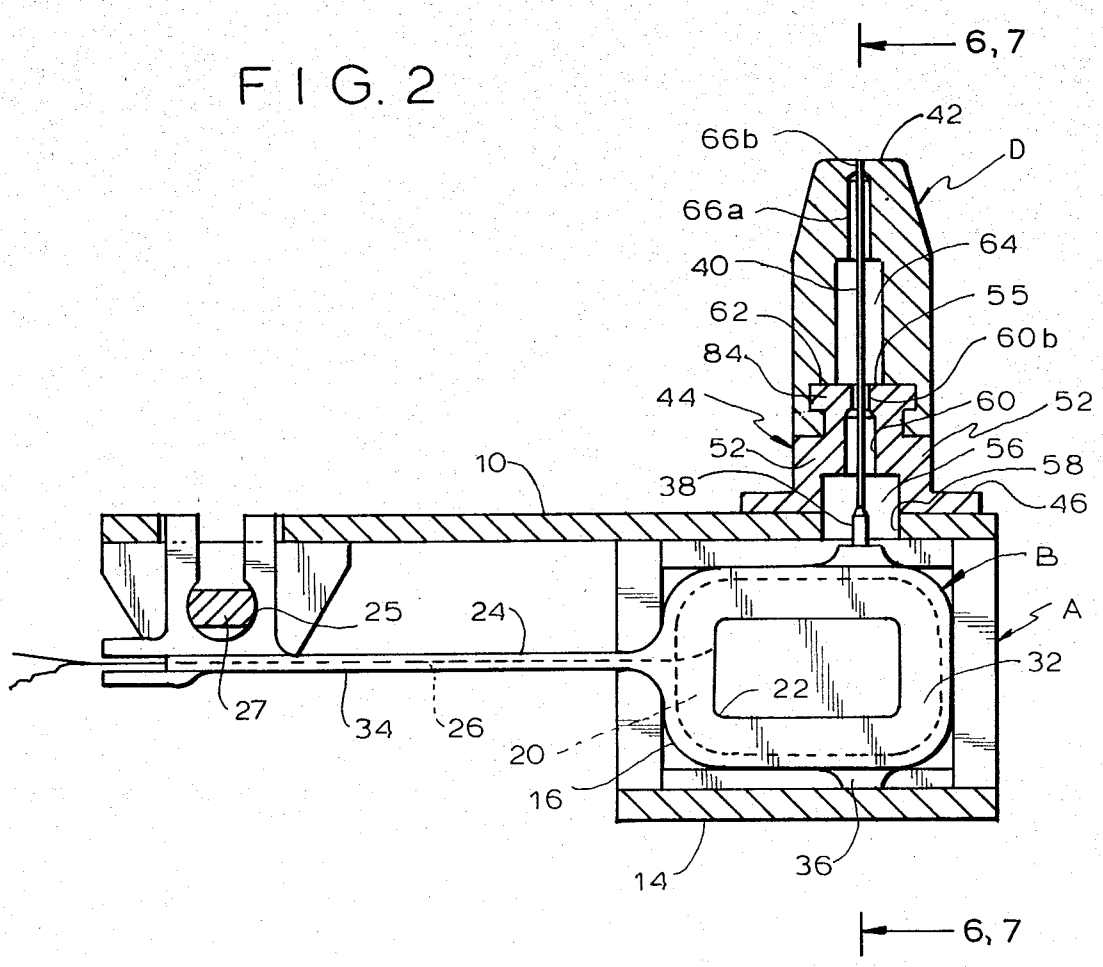
FIG. 2 is a side cross-sectional view showing the hammer and support of the improved dot matrix print head of the present invention.
Figure 3:
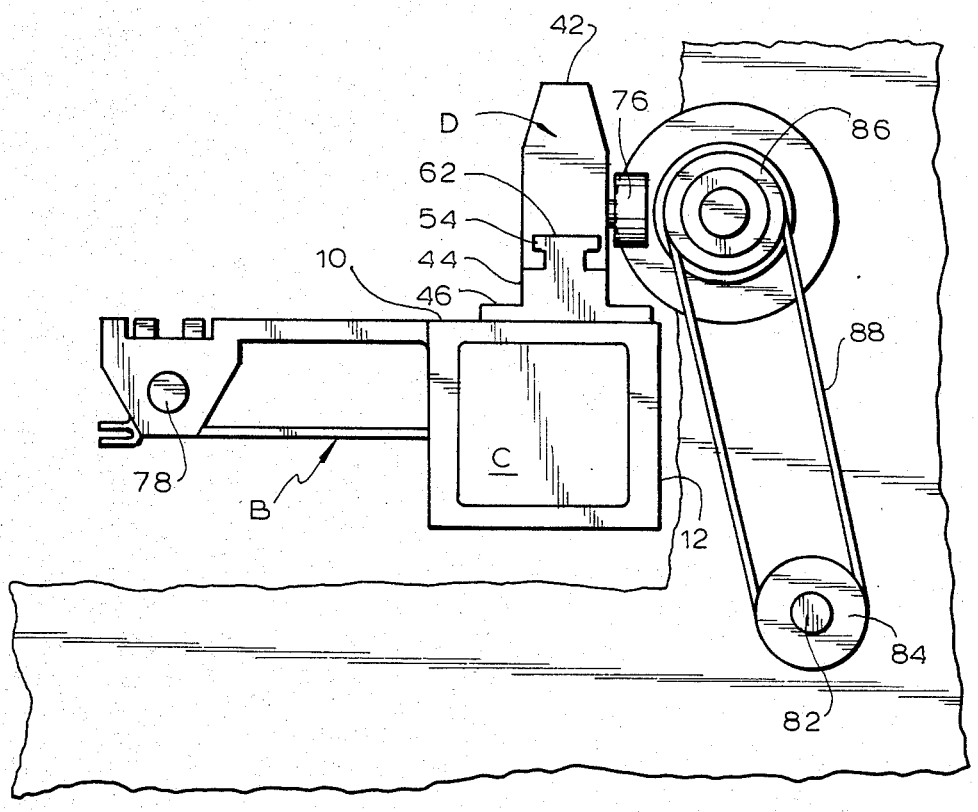
FIG. 3 is a side view of the improved dot matrix print heat of the present invention.
Figure 4:
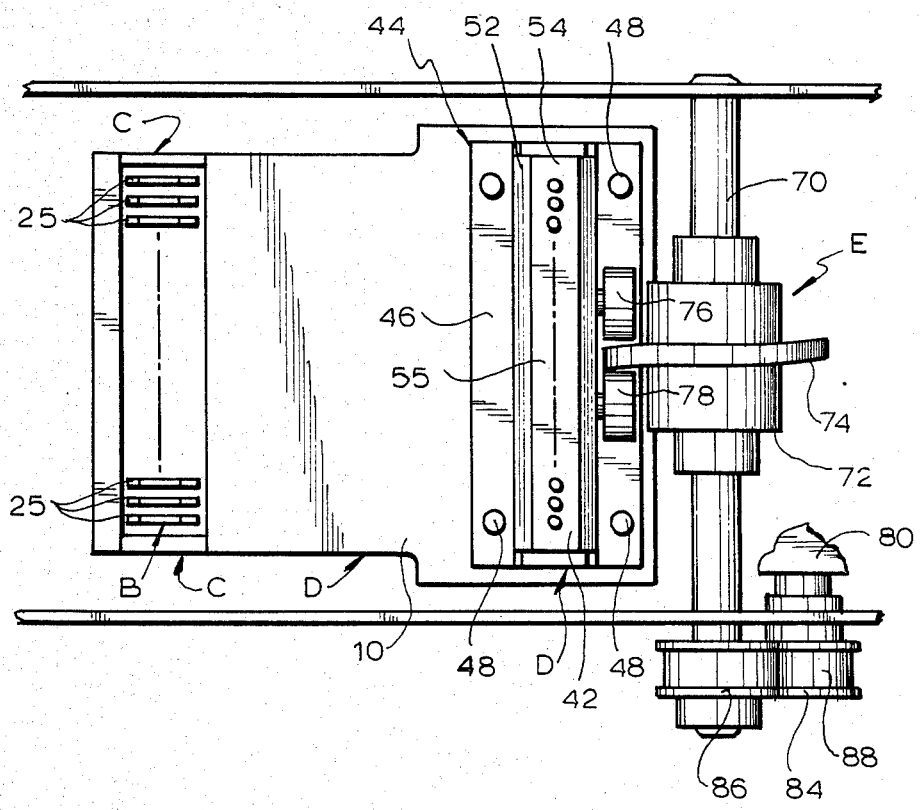
FIG. 4 is a top view of the print head illustrated in FIG. 3.
Figure 5:
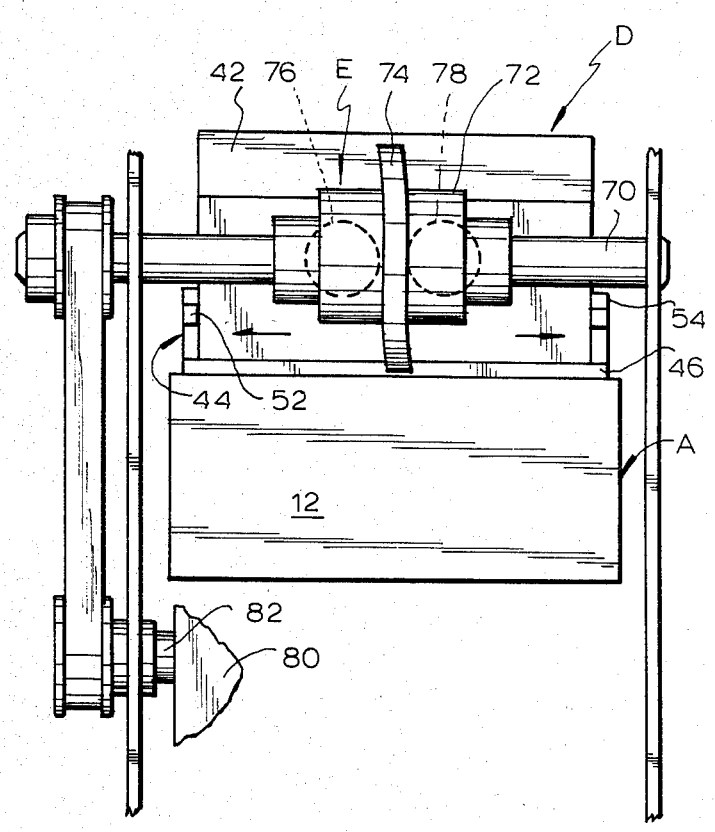
FIG. 5 is a rear view of the print head illustrated in FIG. 3.

As shown in FIGS. 1 and 2, the present invention relates to an improved dot matrix print head which includes a stationary support, generally designated A, into which a plurality of very thin hammer-type actuators, generally designated B, (only one of which is shown) and a pair of permanent magnets, generally designated C, (only one of which is shown) are mounted. Each of the hammers B carries a print wire which extends through a different one of a plurality of openings on the surface of support A and into a positioning member, generally designated D, which engages the impact end thereof. Positioning member D is reciprocated relative to the surface of support A by a moving means, generally designated E.

As positioning member D is moved relative to support A, by means E, the impact end of each of the print wires is, likewise, moved relative to the paper surface to scan same. A selected hammer can be actuated to print a dot at any one of a plurality of different locations on each line on the paper as member D is moved. Actuation of the various print wires is achieved through the use of conventional circuitry, not shown.

Support A comprises an upper surface 10, a front wall 12, and a bottom wall 14, which join to partially define an enclosure with an open rear surface. Within this enclosure, a plurality of very thin hammer actuators B are located. Hammers B are situated in parallel, closely spaced relationship, between a pair of permanent magnets C, with the coil carrying portions thereof situated in a relatively uniform magnetic field created by the magnets.

Each of the hammers B includes a substantially rectangular frame-like portion 16 having a recess 18 therein, also substantially rectangular in configuration. A flat, multi-turn coil 20 is adapted to be received within recess 18 of frame portion 16. Coil 20 also has a central opening or recess 22 therein. Frame-like portion 16 comprises the coil carrying portion of hammer B.

Extending from portion 16 is a flexible elongated portion 24, adapted to mount the coil carrying portion 16 of the hammer to support A. Mounting portion 24 has an elongated recess 26 therein adapted to receive the leads of coil 20, such that same can be connected to the hammer energizing circuitry (not shown).

Each hammer has a bifuricated part 25 with a circular central opening. Part 25 extends from the rear of mounting portion 24 in a generally perpendicular direction thereto. An elongated, flatened shaft 27, fixedly mounted between openings 28 in the downwardly extending spaced rear portions of surface 10 of support A, is received within the opening in part 25 such that each hammer is mounted in cantilever fashion to support A.

Affixed to either side of coil carrying portion 16 is a heat dissipating member 30, 32 which serves to retain coil 20 within recess 18, as well as dissipated heat from the coil, and, at the same time, to protect the coil and the sides of the coil carrying portion 16 from wear should the hammer inadvertently contact an adjacent hammer during displacement. Heat dissipating member 32 is provided with an elongated extension 34 which encloses recess 26 so as to protect the fragile leads of coil 20.

On the bottom of coil-carrying portion 16 is a stop member 36 which limits the recoil movement of the hammer in cooperation with bottom surface 14 of support A. Extending from the top surface of coil carrying portion 16, in alignment with stop 36, is an elongated element 38 to which a print wire 40 is mounted. Print wire 40 extends upwardly through support A and through member D, such that the impact end thereof is normally coplanar with surface 42 of member D.

Hammers B are selected for actuation by conventional energizing circuitry (not shown). When selected for actuation, the leads to coil 20 are connected to a power source such that current flows through coil 20 of the selected hammer. Since the hammer is situated within a magnetic field created by magnets C, the flow of current through the coil results in an electro-motive force which will abruptly displace the coil carrying portion 16 of the hammer from its rest position, towards surface 10 of support A, against the resiliency of mounting portion 24. This causes the impact end of print wire 40 to extend a short distance beyond surface 42 of member D such that it causes contact between the paper and an ink impregnated surface to print a dot on the paper. When the energization of the coil terminates, the resiliency of mounting portion 24 will cause the coil carrying portion 16 to move back towards its rest position, away from surface 10 of support A, until stop member 36 is again adjacent bottom surface 14 of support A.

Fixedly mounted to the top surface 10 is a guide member 44 which forms a part of support A. Member 44 includes a relatively wide base 46 which is provided with four openings 48, adapted to align with openings 50 in surface 10, such that guide member 44 can be mounted to surface 10 by screws or the like. Extending from base 46 of guide member 44 is a rectangular part 52, which is substantially narrower than base 46. Located on top of part 52 is mounted a "T"-shaped keyway 54.

Figure 6:
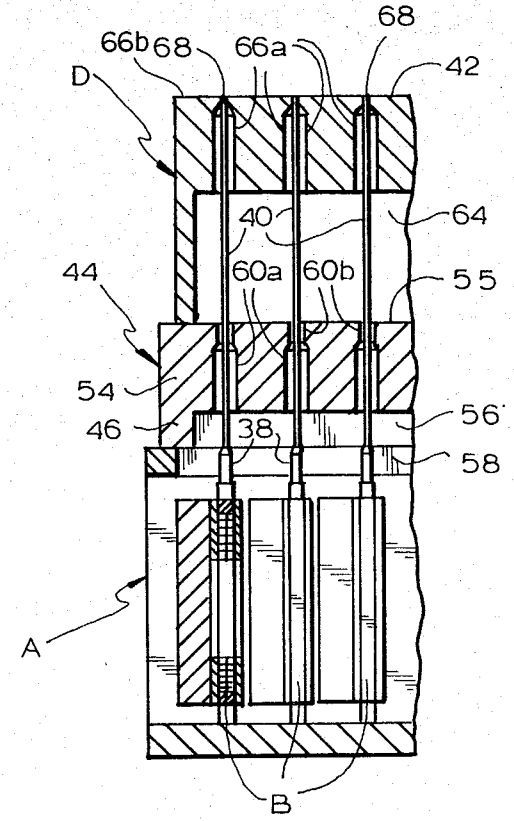
FIG. 6 is a fragmentary cross-sectional view taken along line 6—6 of FIG. 2.

The internal structure of member 44 can best be appreciated by a comparison of FIGS. 2 and 6. Base 46 and the lower portion of part 52 are provided with an elongated rectangular opening 56 which extends along the most of the length of guide member 44. Opening 56 in guide member 44 aligns with opening 58 in surface 10 to provide clearance for the movement of the print wire mounting elements 38, when the hammers are actuated.

The upper portion of part 52 and keyway 54 are provided with a plurality of passageways 60, each of which aligns with and receives a different one of the print wires 40 from hammers B. Each of the passageways 60 has a lower section **60*a* and an upper section 60*b*. The lower section 60*a* of the passageway has a relatively large inner diameter, substantially larger than the outer diameter of the print wire. The diameter of section 60*a* tapers down to a much smaller diameter in section 60*b*, which is equal to the diameter of the aligned opening in surface 54**, but still somewhat larger than the outer diameter of the print wire, so as to permit limited flexing of the print wire relative to its straight condition.

The bottom portion of member D has a "T"-shaped channel 62 therein. "T"-shaped keyway 54 is received in correspondingly shaped channel 62 in member D such that member D can move laterally with respect to stationary surface A. The keyway and channel combination serve to guide the movement of member D.

Member D is made of a low mass, low inertial material, such as Delrin or the like. Thus, member D can be moved and stopped accurately and quickly, with minimum application of energy.

The interior structure of member D can also be appreciated with reference to FIGS. 2 and 6. Positioning member D has a relatively large hollow chamber 64 which extends between the upper surface 55 of keyway 54 approximately two-thirds the length of member D. Thus, member D is at least partially hollow, reducing the inertia thereof even further. A plurality of passageways 66—one for each print wire—extend from the top of chamber 64 to surface 42. Each of the passageways 66 includes a first section **66*a* which has an inner diameter which is substantially greater than the outer diameter of the print wire. At the top of each passageway section 66*a*, the diameter of the passageway abruptly tapers to form a second passageway section 66*b* which has an inner diameter which is only slightly greater than the diameter of print wire 40. Section 66*b* engages the impact end of the print wire 44 in a manner which permits little, if any, lateral movement of the impact end relative to surface 42. Each section 66*b* terminates in a different opening 68 on the surface 42 of member D. Openings 68** are preferably spaced approximately ⅛ inch apart.

The impact end of each print wire 40 is thus held within a different one of the openings 68 in surface 42 and is normally coplanar with surface 42. However, when the hammer from which the print wire extends is actuated, the impact end of the print wire will abruptly protrude beyond surface 42. The position of the impact end of the print wire of an actuated hammer relative to the paper, which is defined by the position of member D relative to support A, will determine the location on the paper of the dot imprinted by the actuation of the hammer.

Figure 7:
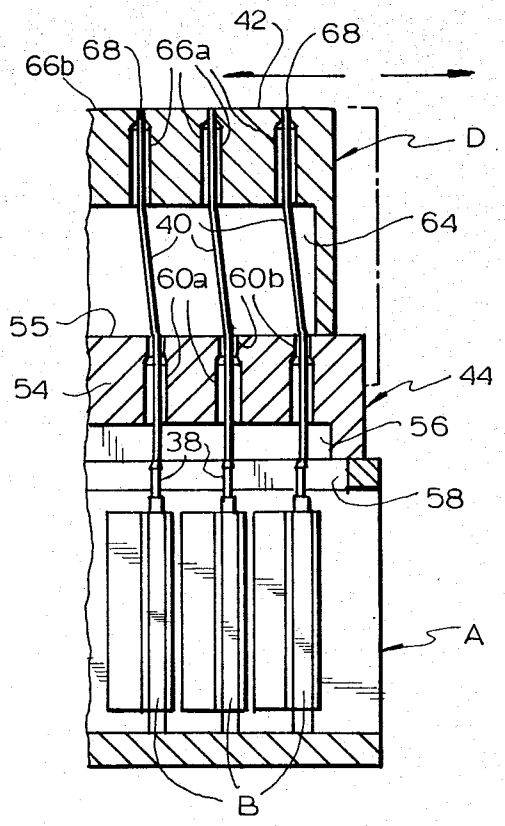
FIG. 7 is a fragmentary cross-sectional view taken along line 7—7 of FIG. 2, showing the displacement of the movable member relative to the stationary frame.

Member D will be moved relative to support A in a reciprocating motion so as to move the impact ends of the print wires relative to the paper. FIGS. 6 and 7 illustrate the movement of member D. FIG. 6 shows member D in its "home" or center position within its range of movement with respect to support A. In this position, each of the print wires 40 is substantially straight. Member D is movable along keyway 54 a short distance to the left and to the right of the "home" position. In FIG. 7, member D is shown in solid at the extreme left position in its range, in phantom at the extreme right position within its range.

As will be appreciated from FIG. 7, when member D is moved relative to its "home" position, the portion of each of the print wires between surface 55 and surface 42 will flex or curve slightly. However, this flexing or curvature will be relatively minor because the displacement of member D in either direction from its "home" position is small. Due to the minor flexing of the print wires, the impact ends thereof can imprint dots on different locations on the paper, in accordance with the position of member D when the hammers are actuated. Neither the movement of member D nor the flexing or curving of the print wires affect the position of the hammers or cause any lateral movement thereof.

Means E causes positioning member D to "shuttle" or reciprocate within a given range with respect to support member A. Means E comprises a rotatable shaft 70 upon which is mounted a substantially cylindrical member 72. Extending outwardly from the outer surface of cylindrical member 72 is a flange or annular track 74, a portion of which is received within a recess defined between a pair of spaced rollers 76, 78. Rollers 76 and 78 are rotatably mounted on the surface of member D.

Track 74 is not situated entirely in a plane perpendicular to and bisecting the surface of cylindrical member 72, but, instead, is skewed with respect thereto. If the distance between the track and the plane were graphed around the surface of the member, a sinesoidal-like curve with extended linear top and bottom portions would result. Thus, one section of the track lies to one side of the plane, and another section of the track lies on the other side of the plane. As shaft 70 is rotated and track 74 moves through the recess between members 76 and 78, member D will follow the position of the portion of the track situated between members 76 and 78 and "shuttle" back and forth with respect to support A. While this motion is continuous between one extreme of the path of movement and the other, the movement is interrupted at each extreme to permit member D to stop or "dwell" for a brief period at each extreme of its path of movement, to permit indexing of the paper.

For example, assume that shaft 70 begins at 0° rotation with member D at the extreme left portion of its path of movement, as illustrated in solid in FIG. 7. The operative portion of track 74 (that portion within the recess defined between rollers 76 and 78) is at its extreme left position with respect to a center plane bisecting cylindrical member 72. For the first few (eight) degrees of rotation, the operative portion of track 74 is straight and remains at its extreme left position such that member D will remain at its extreme left position. Starting at 9° of rotation, the operative portion of track 74 begins to curve towards the plane and will move continuously towards the plane until 90° of rotation, where it coincides with the plane. At this position, member D is in the position shown in FIG. 6, that is, the "home" position.

Beginning at 90° of rotation, the operative portion of the track will move continuously towards the right, until at 172°, it reaches its right limit. At this point, member D will be in its extreme right position, as shown in phantom in FIG. 7. Between 172° and 188°, the operative portion of track 74 is straight, such that member D remains in its right-most position.

Beginning at 189° rotation, the operative portion of the track will move back continuously towards the central plane, reaching same at 270° rotation. As this occurs, member D moves from its extreme right position back to its "home" position. From 270° to 352°, the operative portion of track 74 will move from the central plane to its left extremity, such that member D moves towards its left-most limit, as illustrated in solid in FIG. 7. At 352°, the operative portion of the track has reached its left-most limit and is straight through 360°, until 8° in the next rotation, when it will reverse movement and move back towards the central plane.

It should now be apparent that the track has a sinusoidal curvature with extended linear portions at each extreme. Thus, member D will reciprocate or "shuttle" relative to surface A, while stopping or "dwelling" at each extreme of its movement, for a rotation of 16° of cylindrical member 72. This "dwell" period provides sufficient time for the paper to be moved relative to the print head such that the next line of symbols can be printed thereon.

The rotation of shaft 70 is caused by a motor 80 having a rotatable output shaft 82. Shaft 82 has a pulley 84 mounted thereto. Pulley 84 is connected to a pulley 86 fixed on shaft 70 by belt 88.

Rotation of shaft 70 causes member D, and thus the impact ends of the print wires 40, to move back and forth with respect to the paper, within a relatively small range. "Dwell" periods of relatively short duration are provided at either extreme of the range. Each of the hammers can be actuated a plurality of different times during each movement of member D. The timing of the actuation and the selection of the hammers will determine the locations of the imprinted dots, as well as the spacing therebetween.

Positioning member D can be moved quickly and accurately because it is composed of low mass material and is partially hollow, such that the inertia thereof is quite small. The higher mass hammers are not moved laterally.

In addition, it should be appreciated that while member D moves to one side or the other of its "home" position, this movement is relatively slight such that the curvature of the print wire, even at the extreme positions, is quite slight. Moreover, the internal structures of guide member 44 and positioning member D are such that the print wires are supported in such a way that the minor flexing cannot result in damage or permanent bending of the print wires.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims:

I claim:

1. A head for printing a dot on a paper comprising a support, a print wire having an impact end, an actuator operably connected to said support, active on said print wire, and effective, when actuated, to move said impact end of said print wire towards the paper, means adapted to engage said print wire beyond said actuator and towards said paper, for positioning same relative to the paper, and means for moving said positioning means relative to said support, said positioning means comprising a solid body portion having first and second surfaces and a generally cylindrical passageway extending therebetween, and a hollow portion extending between said body portion and said support for movably mounting said body portion on said support with said second surface spaced therefrom, said passageway having an internal diameter greater than the diameter of said print wire to permit lateral movement of said print wire relative to said second surface as said positioning means is moved relative to said support, said passageway terminating proximate said first surface of said body portion in an impact end receiving opening with a diameter slightly greater than the diameter of said print wire so as to prevent substantial relative lateral movement between said impact end and said first surface of said body portion.

* * * * *